US007165996B1

(12) United States Patent
Kao

(10) Patent No.: US 7,165,996 B1
(45) Date of Patent: Jan. 23, 2007

(54) CABLE CONNECTOR WITH ANTI-ELECTROMAGNETIC INTERFERENCE CAPABILITY

(75) Inventor: Shin-Shun Kao, Jhonghe (TW)

(73) Assignee: T-Conn Precision Corp., Taipei (TW)

( * ) Notice: Subject to any disclaimer, the term of this patent is extended or adjusted under 35 U.S.C. 154(b) by 0 days.

(21) Appl. No.: 11/161,458

(22) Filed: Aug. 4, 2005

(51) Int. Cl.
*H01R 13/648* (2006.01)

(52) U.S. Cl. ..... 439/607

(58) Field of Classification Search ..... 439/607, 439/610, 357, 367, 587, 877
See application file for complete search history.

(56) References Cited

U.S. PATENT DOCUMENTS 4,653,825 A * 3/1987 Olsson ..... 439/295
5,338,227 A * 8/1994 Nakamura ..... 439/607
6,139,365 A * 10/2000 Lok ..... 439/607
6,152,771 A * 11/2000 Juntwait ..... 439/607
6,582,252 B1 * 6/2003 Lin ..... 439/610
6,607,397 B1 * 8/2003 Zhang et al. ..... 439/357
6,659,655 B1 * 12/2003 Dair et al. ..... 385/92
2006/0040554 A1 * 2/2006 Liu ..... 439/607

* cited by examiner

*Primary Examiner*—Chandrika Prasad
(74) *Attorney, Agent, or Firm*—Morris Lin; T-Conn Precision Corp.

(57) ABSTRACT

The present invention provides a cable connector. The cable connector comprises a first metal case, a second metal case, an isolator base, a support base, a terminal base and a cable. The base of the support base is positioned in the isolator base, and then the isolator base is positioned in the first metal case such that the hollow fastener of the support base passes through the through hole of the first metal case. The cable is passed through the hollow fastener of the support base. The second metal case is assembled to the first metal case such that the connecting holes formed on the sidewalls of the second metal casing correspond to the slots formed on the sidewalls of the first metal case. The protruding blocks of the second metal case are bent toward the first metal case to securely cover the first metal case.

4 Claims, 2 Drawing Sheets

CABLE CONNECTOR WITH ANTI-ELECTROMAGNETIC INTERFERENCE CAPABILITY

FIELD OF THE INVENTION

The present invention generally relates to a cable connector, and more particularly to a cable connector in which all components are properly secured so that the anti-electromagnetic interference capability of the cable connector can be effectively promoted.

DESCRIPTION OF THE RELATED ART

The conventional "cable components", such as disclosed in publication No. 093204634 published in Patent Bulletin of the Republic of China, includes an insulator, a metal cover for covering the insulator, a space for the insulator and a adaptor. A plurality of conductive terminals is disposed inside the insulator. The adapter has a connecting area extending through the opening at the long side of the metal cover. The adaptor has a hole for the cable to pass through and lead the cable to the space inside the metal cover so that the core wires of the cable may be connected to the conductive terminals disposed inside the insulator.

Even though the design of the cable connector described above is capable of reducing the height and also capable of reducing electromagnetic interference, however, there is no structure for properly securing the connection among the adaptor, the cable and the sleeve. The connection between the first and second parts of the metal cover is merely connected by the concave and convex ends, and therefore the anti-electromagnetic interference effect of the conventional cable connector is limited.

SUMMARY OF THE INVENTION

Accordingly, the present invention is directed to a structure of a cable connector wherein connections among all components of the cable connector are properly secured to improve the anti-electromagnetic interference capability of the cable connector.

According to an aspect of the present invention, the cable connector comprises a first metal case, a second metal case, an isolator base, a support base, a terminal base and a cable. The second metal case is adopted for covering the first metal case to improve the anti-electromagnetic interference capability of the cable connector.

According to an aspect of the present invention, the base of the support base is positioned in the isolator base, and then the isolator base is positioned in the first metal case such that the hollow fastener of the support base passes through the through hole of the first metal case. Next, the cable is passed through the hollow fastener of the support base, and then the core wires of the cable are electrically connected to the contact terminals. Next, the second metal case is assembled to the first metal case such that the connecting holes formed on the sidewalls of the second metal casing correspond to the slots formed on the sidewalls of the first metal case. Finally, the protruding blocks of the second metal case are bent toward the first metal case to securely cover the first metal case. Thus, all components of the cable connector may be properly secured and the anti-electromagnetic interference capability of the cable connector may be substantially improved.

BRIEF DESCRIPTION OF THE DRAWINGS

For a more complete understanding of the present invention, reference will now be made to the following detailed description of preferred embodiments taken in conjunction with the accompanying drawings, in which.

DESCRIPTION OF THE EMBODIMENTS

The features and the advantages of the present invention will be more readily understood upon a thoughtful deliberation of the following detailed description of a preferred embodiment of the present invention with reference to the accompanying drawings.

Figure 1:
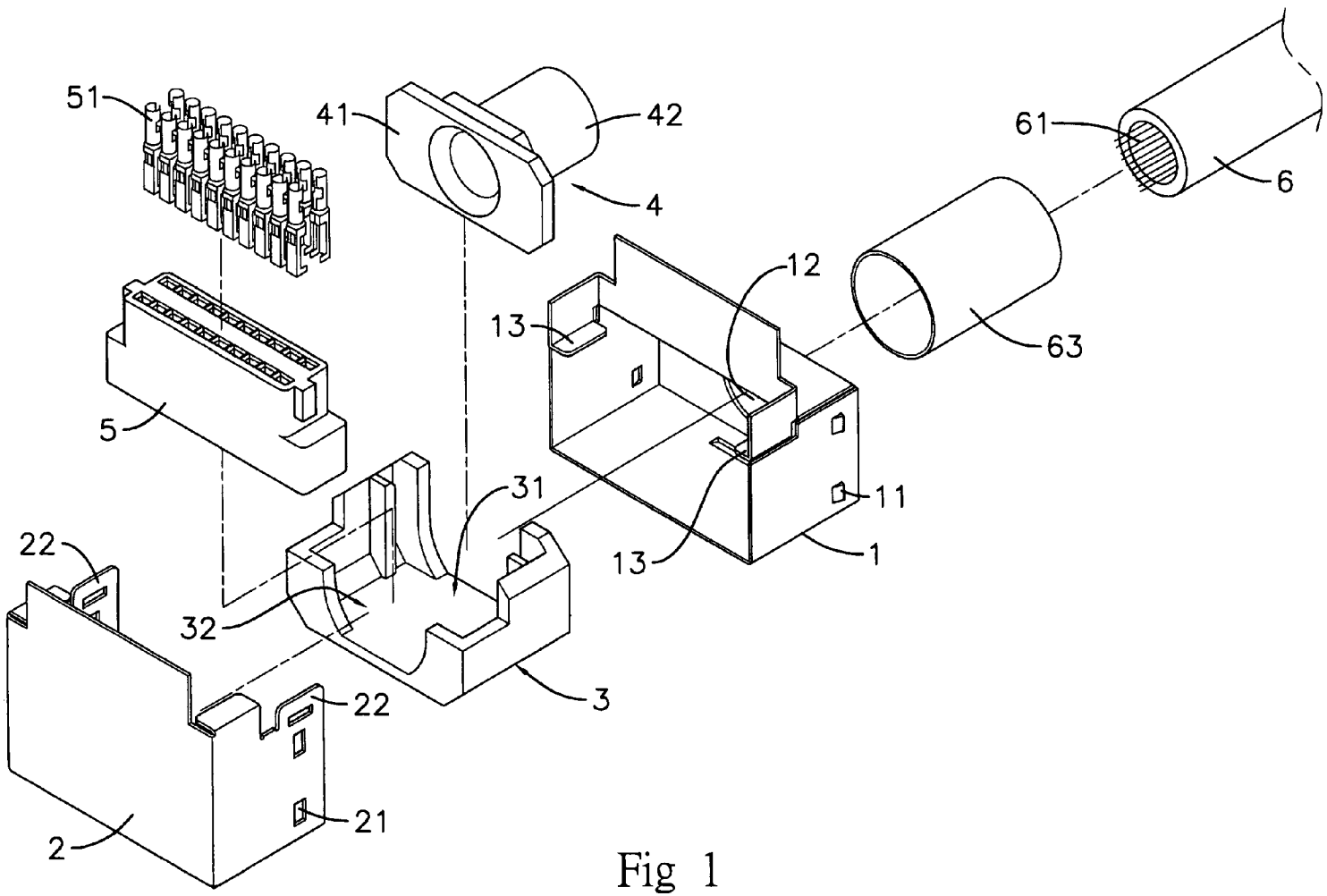
FIG. 1 illustrates an exploded view of a cable connector according to an embodiment of the present invention.
Figure 2:
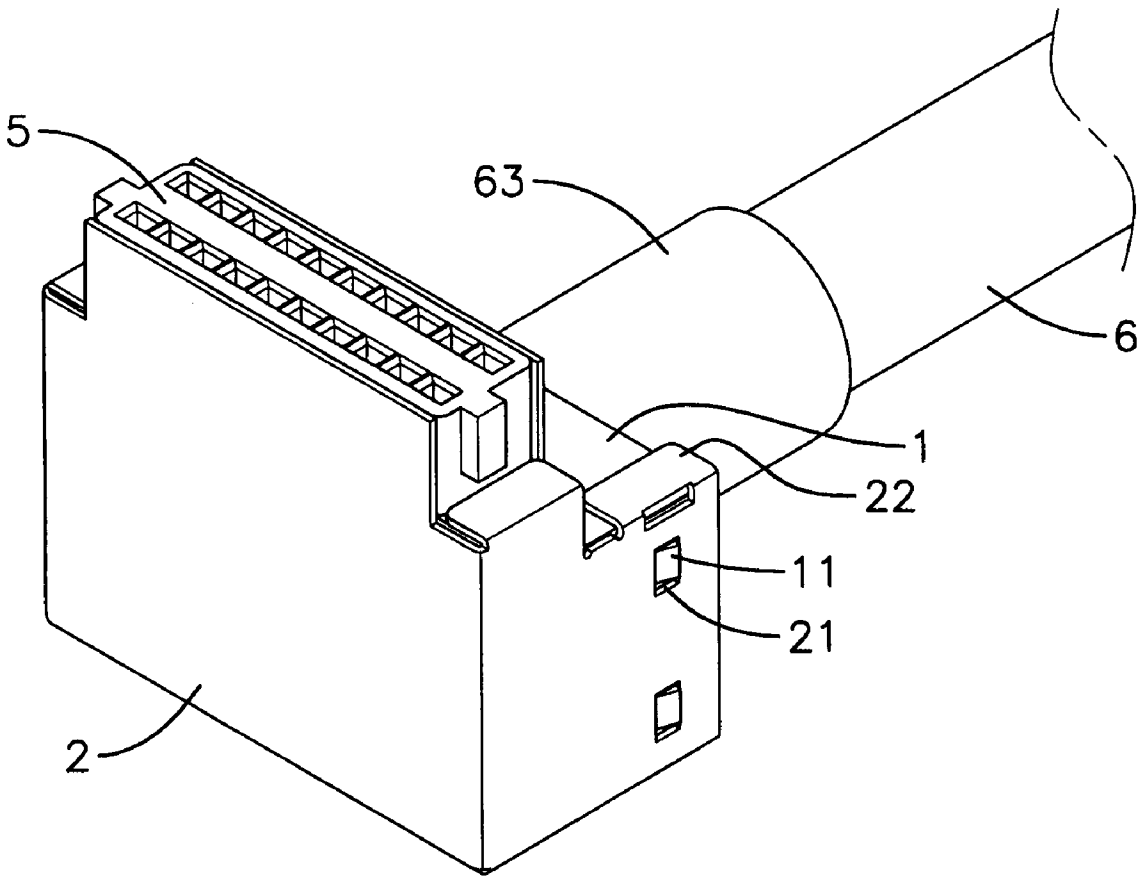
FIG. 2 illustrates an elevational view of the cable connector according to an embodiment of the present invention.

Referring to FIGS. 1 and 2, the cable connector of the present invention comprises a first metal case 1, a second metal case 2, an isolator base 3, a support base 4, a terminal base 5 and a cable 6.

The first metal case 1 comprises slots 11 formed on two sidewalls thereof and a through hole 12 formed in the central region of the rear surface thereof. Stoppers 13 are disposed on the two sidewalls of the first metal case 1.

The second metal case 2 comprises connecting holes 21 formed on the sidewalls thereof corresponding to the aforementioned slots 11 formed on the sidewalls of the first metal case 1, and indented protruding blocks 22 disposed on two end portions of the second metal casing 2. The second metal case 2 is adopted for covering the first metal casing 1.

The isolator base 3 comprises a first receiving space 31, a second receiving space 32 and an indent positioned on the two end portions of the isolator base 3. The isolator base 3 can be placed inside the first metal case 1.

The support base 4 comprises a base 41 and a hollow fastener 42 extending from one side of the base 41, wherein the base 41 can be positioned in the first receiving space 31 of the isolator base 3 and the hollow fastener 42 can be passed through the through hole 12 of the first metal case 1.

The terminal base 5 can be positioned in the second receiving space 32 of the isolator base 3. A plurality of contact terminals 51 may be disposed on the terminal base 5.

The cable 6 comprises core wires 61 for electrically connecting to the contact terminals 5. The cable 6 can be passed through the hollow fastener 42 of the support base 4.

Hereinafter, the assembly of the above-mentioned components of the present invention will be described. First, the base 41 of the support base 4 is placed in the first receiving space 31 of the isolator base 3, and then the isolator base 3 is placed in the first metal case 1 such that the hollow fastener 42 of the support base 4 passes through the through hole 12 of the first metal case 1 until the indent formed on two end portions of the isolator base 3 is positioned by the stopper 13 formed on the sidewalls of the first metal case 1. Next, the cable 6 is passed through the hollow fastener 42 of the support base 4, and then the core wires 61 are electrically connected to the contact terminals 51. A heat-shrinkable tubing 63 may be disposed to cover the exposed portion of the hollow fastener 42 and the cable 6 for securely positioning cable 6. Next, the second metal case 2 is assembled to the first metal case 1 such that the connecting holes 21 formed on the sidewalls of the second metal casing 2 correspond to the slots 11 formed on the sidewalls of the first metal case 1. Finally, the protruding blocks 22 of the second metal case 2 are bent toward the first metal case 1 to securely cover the first metal case 1. Thus, the assembly of the components of the cable connector can be substantially simplified and properly secured. According to an aspect of the present invention, the second metal case 2 is adopted for reducing electromagnetic interference.

Thus, the present invention provides a structure of the cable connector in which all components of the cable connector are properly secured and covered by the second metal case so that the anti-electromagnetic interference capability of the cable connector may be substantially promoted.

Although the invention has been explained in relation to its preferred embodiment, it is to be understood that many other possible modifications and variations ca be made without departing from the spirit and scope of the invention as hereinafter claimed.

What is claimed is:

1. A cable connector, comprising:

a first metal case, comprising slots formed on sidewalls thereof and a through hole formed in a central region of a rear surface thereof;

a second metal case, for covering the first metal case, comprising connecting holes positioned corresponding to the slots formed on the sidewalls of the first metal case;

an isolator base, placed in the first metal case, comprising a first receiving space and a second receiving space;

a support base, comprising a base and a hollow fastener extending from one side thereof, wherein the base of the support base is placed in the first metal case such that the hollow fastener passes through the through hole of the first metal case;

a terminal base, placed in the second receiving space of the isolator base, comprising a plurality of contact terminals disposed thereon; and a cable, passing through the hollow fastener formed in the supporting base, comprising core wires for electrically connecting to the contact terminals.

2. The cable connector according to claim 1, wherein said first metal case comprises a stopper extending from two sidewalls thereof.

3. The cable connector according to claim 1, wherein said second metal case comprises a protruding block formed on two sidewalls thereof.

4. The cable connector according to claim 1, further comprising a heat-shrinkable tubing disposed on exposed portion of the hollow fastener and the cable.

* * * * *